US011402146B2

(12) United States Patent
Jeon et al.

(10) Patent No.: US 11,402,146 B2
(45) Date of Patent: Aug. 2, 2022

(54) REFRIGERATOR

(71) Applicant: SAMSUNG ELECTRONICS CO., LTD., Suwon-si (KR)

(72) Inventors: Byung Woo Jeon, Seoul (KR); Il Sung Bae, Seongnam-si (KR); Joo Hee Song, Suwon-si (KR); Ki-Hyun Kim, Suwon-si (KR); Byung Kwan Yang, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/043,139

(22) PCT Filed: Sep. 14, 2018

(86) PCT No.: PCT/KR2018/010825
§ 371 (c)(1),
(2) Date: Sep. 29, 2020

(87) PCT Pub. No.: WO2019/190006
PCT Pub. Date: Oct. 3, 2019

(65) Prior Publication Data

US 2021/0095910 A1 Apr. 1, 2021

(30) Foreign Application Priority Data

Mar. 30, 2018 (KR) ..... 10-2018-0037644

(51) Int. Cl.
*F25D 17/06* (2006.01)
*F25C 1/24* (2018.01)
*F25D 23/04* (2006.01)

(52) U.S. Cl.
CPC ..... *F25D 17/065* (2013.01); *F25C 1/24* (2013.01); *F25D 23/04* (2013.01)

(58) Field of Classification Search
CPC ..... F25D 17/065; F25D 23/04; F25D 17/045; F25D 2317/062; F25D 2317/0665; F25C 1/24; F25C 5/22
See application file for complete search history.

(56) References Cited

U.S. PATENT DOCUMENTS 6,945,068 B2 * 9/2005 Kim ..... F25D 17/065 62/353
2008/0295539 A1 * 12/2008 An ..... F25C 5/22 62/407

(Continued)

FOREIGN PATENT DOCUMENTS

EP 2 613 110 A2 7/2013
JP 5-180557 A 7/1993

(Continued)

OTHER PUBLICATIONS

Extended European Search Report dated Mar. 24, 2021, in corresponding European Patent Application No. 18912139.5.

(Continued)

*Primary Examiner* — Elizabeth J Martin
(74) *Attorney, Agent, or Firm* — Staas & Halsey LLP

(57) ABSTRACT

A refrigerator includes a main body including an inner case and an outer case, a storage compartment defined by the inner case, a door configured to open and close the storage compartment, an ice making chamber disposed on a rear surface of the door, a fan configured to supply cold air to the storage compartment and the ice making chamber, and a guide passage formed by being recessed into the inner case to guide cold air supplied by the fan to the ice making chamber. The inner case includes an upper wall, and the guide passage is formed by being recessed into the upper wall of the inner case to be exposed to the storage compartment.

18 Claims, 15 Drawing Sheets

(56) References Cited

U.S. PATENT DOCUMENTS

| | | | | |
|---|---|---|---|---|
| 2009/0173098 | A1* | 7/2009 | Kim | F25C 5/22 62/344 |
| 2013/0027906 | A1* | 1/2013 | Ueda | F25D 27/00 362/92 |

FOREIGN PATENT DOCUMENTS

| | | | |
|---|---|---|---|
| JP | 2006-189179 | A | 7/2006 |
| KR | 10-2008-0106688 | A | 12/2008 |
| KR | 10-2009-0105988 | A | 10/2009 |
| KR | 10-2009-0133022 | A | 12/2009 |
| KR | 10-2010-0113206 | A | 10/2010 |
| KR | 10-2013-0079851 | A | 7/2013 |
| KR | 10-2016-0023282 | A | 3/2016 |

OTHER PUBLICATIONS

International Search Report, PCT/ISA/210, dated Jan. 15, 2019, in corresponding International Patent Application No. PCT/KR2018/010825.

* cited by examiner

REFRIGERATOR

CROSS-REFERENCE TO RELATED APPLICATIONS

This application is a U.S. National Stage Application which claims the benefit under 35 U.S.C. § 371 of International Patent Application No. PCT/KR2018/010825 filed on Sep. 14, 2018, which claims foreign priority benefit under 35 U.S.C. § 119 of Korean Patent Application No. 10-2018-0037644 filed on Mar. 30, 2018, in the Korean Intellectual Property Office, the contents of both of which are incorporated herein by reference.

TECHNICAL FIELD

The present disclosure relates to a refrigerator, and more particularly, to a refrigerator having an improved structure to improve ice making performance.

BACKGROUND ART

A refrigerator is a home appliance including a main body having a storage compartment, a cold air supply device for supplying cold air to the storage compartment, and a door for opening and closing the storage compartment to keep food in a fresh state.

The refrigerator may further include an ice maker for making ice and an ice bucket for storing the made ice.

The ice maker may include an ice making tray in which water is stored, and a cold air passage provided to move cold air. In general, the cold air passage may be provided so that cold air is delivered directly to water stored in the ice making tray. When the cold air passage is designed as above, the ice making performance may be degraded.

The storage compartment may be provided with a guide duct to guide cold air to the ice maker. The guide duct may be mounted on an inner wall of the storage compartment. The guide duct having a predetermined volume may act as a factor limiting the space utilization of the storage compartment.

DISCLOSURE

Technical Problem

The present disclosure is directed to providing a refrigerator with an improved structure so that cold air may be effectively delivered to an ice maker.

The present disclosure is directed to providing a refrigerator with an improved structure to secure a wide storage space.

The present disclosure is directed to providing a refrigerator with an improved structure to reduce a manufacturing cost.

Technical Solution

One aspect of the present disclosure provides a refrigerator including a main body including an inner case and an outer case, a storage compartment defined by the inner case, a door configured to open and close the storage compartment, an ice making chamber provided on a rear surface of the door, a cold air supply device configured to supply cold air to the storage compartment and the ice making chamber, and a guide passage formed by being recessed into the inner case to guide cold air generated in the cold air supply device to the ice making chamber, wherein the inner case includes an upper wall, and the guide passage is formed by being recessed into the upper wall of the inner case to be exposed to the storage compartment.

The inner case may include a rear wall, and a cold air inlet through which cold air generated in the cold air supply device is introduced into the storage compartment may be formed on the rear wall of the inner case.

The inner case may include a rear wall, and the refrigerator may further include a duct cover defining a cold air supply duct in which the cold air supply device is accommodated together with the rear wall of the inner case, and a cold air inlet through which cold air generated in the cold air supply device is introduced into the storage compartment may be formed on the duct cover.

The refrigerator may further include an illumination device installed on the upper wall of the inner case to illuminate the storage compartment and positioned between the guide passage and the ice making chamber to guide the cold air together with the guide passage to the ice making chamber.

The illumination device may include a light emitting surface inclined toward the ice making chamber with respect to the upper wall of the inner case so that the cold air moves along the light emitting surface.

The door may include a front plate forming an outer appearance of the refrigerator together with the outer case of the main body, and a rear plate defining the rear surface of the door and coupled to a rear surface of the front plate, and the ice making chamber may include an ice making frame coupled to the rear plate, an ice making casing coupled to at least one of the ice making frame and the rear plate to form an ice making space therein, and an ice making chamber cover including a plurality of cold air inflow slits to allow cold air passed through the guide passage to be introduced into the ice making space and forming an outer appearance of the ice making chamber together with the ice making casing.

The refrigerator may further include an ice maker disposed in the ice making space, wherein the ice maker may include an ice making tray including ice making cells to store water and formed of a plastic material.

The ice maker may further include a tray cover coupled to an outer side of the ice making tray, and the ice making frame may be provided with a plurality of guide ribs defining a first cold air passage in which a part of cold air introduced through the plurality of cold air inflow slits moves.

The tray cover may include a first wall facing the ice making frame, and the plurality of guide ribs may extend from the ice making frame to face the first wall of the tray cover.

The tray cover may include a first wall facing the ice making frame, and the first cold air passage may include a first section positioned upstream in a direction in which cold air introduced through the plurality of cold air inflow slit moves and extending in a vertical direction of the refrigerator, and a second section positioned downstream n the direction in which cold air introduced through the plurality of cold air inflow slit moves and extending from the first section to be inclined toward the first wall of the tray cover.

Cold air moving along the first section of the first cold air passage may directly bring into contact with the first wall of the tray cover, and cold air passed through the second section of the first cold air passage may directly bring into contact with an outer surface of a bottom of the ice making tray.

The tray cover may further include a second wall facing the first wall, and a plurality of cold air movement holes, through which a second cold air passage in which another part of the cold air introduced through the plurality of cold air inflow slits moves passes, may be formed on the second wall of the tray cover.

Cold air moving along the second cold air passage may directly bring into contact with one wall of the ice making tray facing the second wall of the tray cover.

The ice making chamber cover and the ice making casing may be disposed to be spaced apart from each other in a vertical direction of the refrigerator to define a cold air outlet, and cold air introduced into the ice making space may be discharged into the storage compartment through the cold air outlet.

Each of the plurality of guide ribs may include one end facing downward, and the one end of each of the plurality of guide ribs may be positioned between an upper end and a lower end of the cold air outlet.

Another aspect of the present disclosure provides a refrigerator including a main body including an inner case and an outer case, a storage compartment defined by the inner case, an ice making chamber provided to generate ice, a cold air supply device configured to supply cold air to the storage compartment and the ice making chamber, and a guide passage formed integrally with the ice making chamber to guide cold air generated in the cold air supply device to the ice making chamber, wherein the guide passage includes a first end positioned upstream in a direction in which the cold air moves, and a second end positioned downstream in the direction in which the cold air moves and having a depth smaller than the first end and a width larger than the first end.

The inner case may include an upper wall, and the guide passage may be formed by being recessed into the upper wall of the inner case to be exposed to the storage compartment.

A guide member may be provided on an upper wall of the inner case to guide cold air moving along the guide passage to the ice making chamber, and the guide member may be positioned on a downstream side of the second end of the guide passage in the direction in which the cold air moves.

The guide member may include an illumination device to illuminate the storage compartment.

The refrigerator may further include a door configured to open and close the storage compartment, and the ice making chamber may be provided on the door.

Advantageous Effects

Instead of designing a cold air passage so that cold air is intensively delivered only to water stored in an ice making tray, by designing the cold air passage so that cold air is delivered not only to water stored in the ice making tray but also to the entire surfaces of the ice making tray, the effect of improving the ice making performance of a refrigerator can be expected.

Instead of mounting a guide duct having a predetermined volume on one wall of an inner case, by forming a guide passage to be recessed into one wall of the inner case, the effect of expanding a storage space of a storage compartment can be expected.

Instead of using a separate member such as the guide duct, by forming the guide passage in the inner case itself, an effect of reducing a manufacturing cost can be expected.

MODE OF THE DISCLOSURE

Hereinafter, embodiments of the present disclosure will be described in detail with reference to the accompanying drawings. In this specification, the terms "front end," "rear end," "upper portion," "lower portion," "upper end" and "lower end" used in the following description are defined with reference to the drawings, and the shape and position of each component are not limited by these terms.

Hereinafter, "X" refers to the front and rear directions of a refrigerator 1, and "Y" refers to the left and right directions of the refrigerator 1. "Z" refers to the vertical direction of the refrigerator 1.

Figure 1:
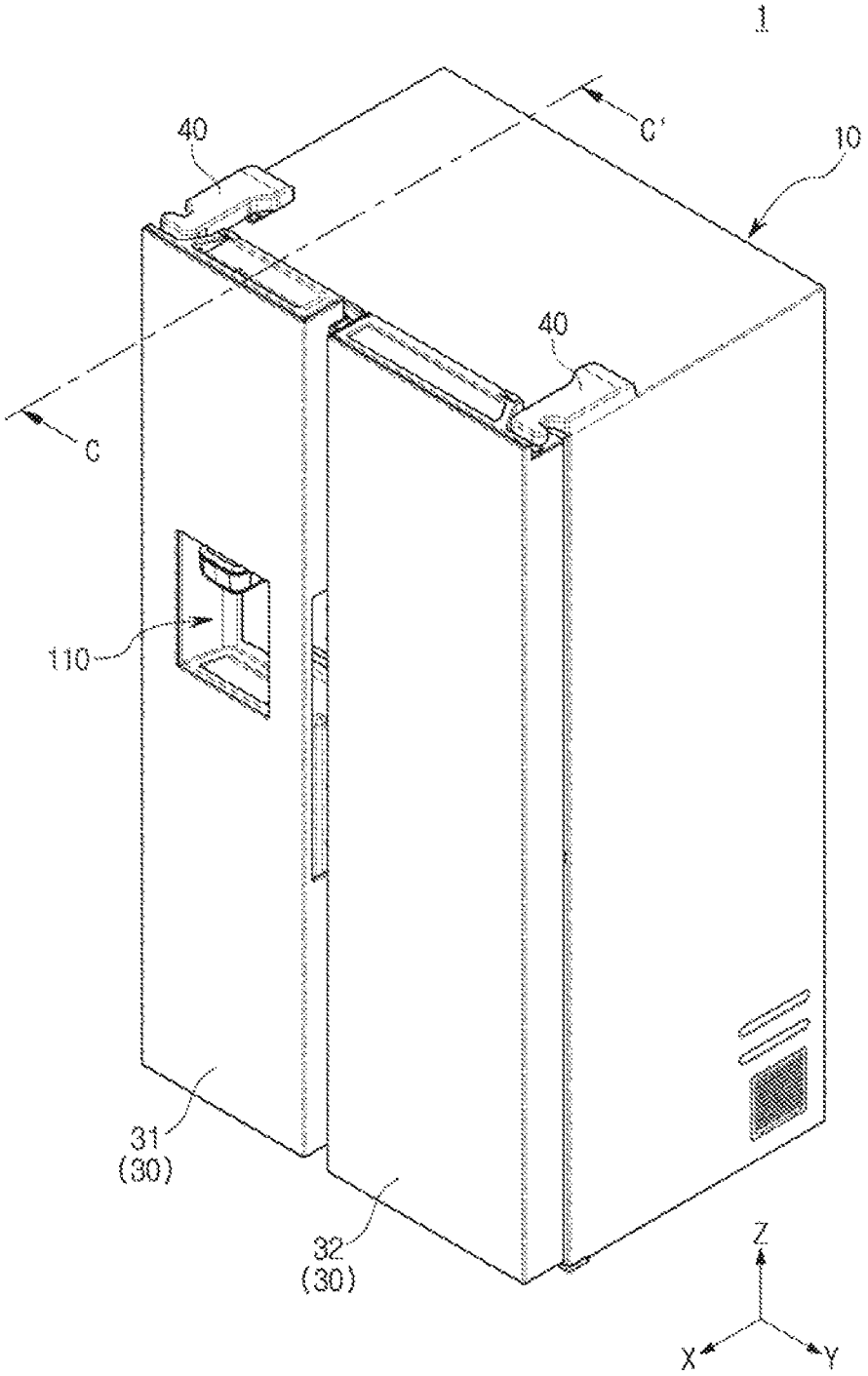
FIG. 1 is a perspective view of a refrigerator according to an embodiment of the present disclosure.
Figure 2:
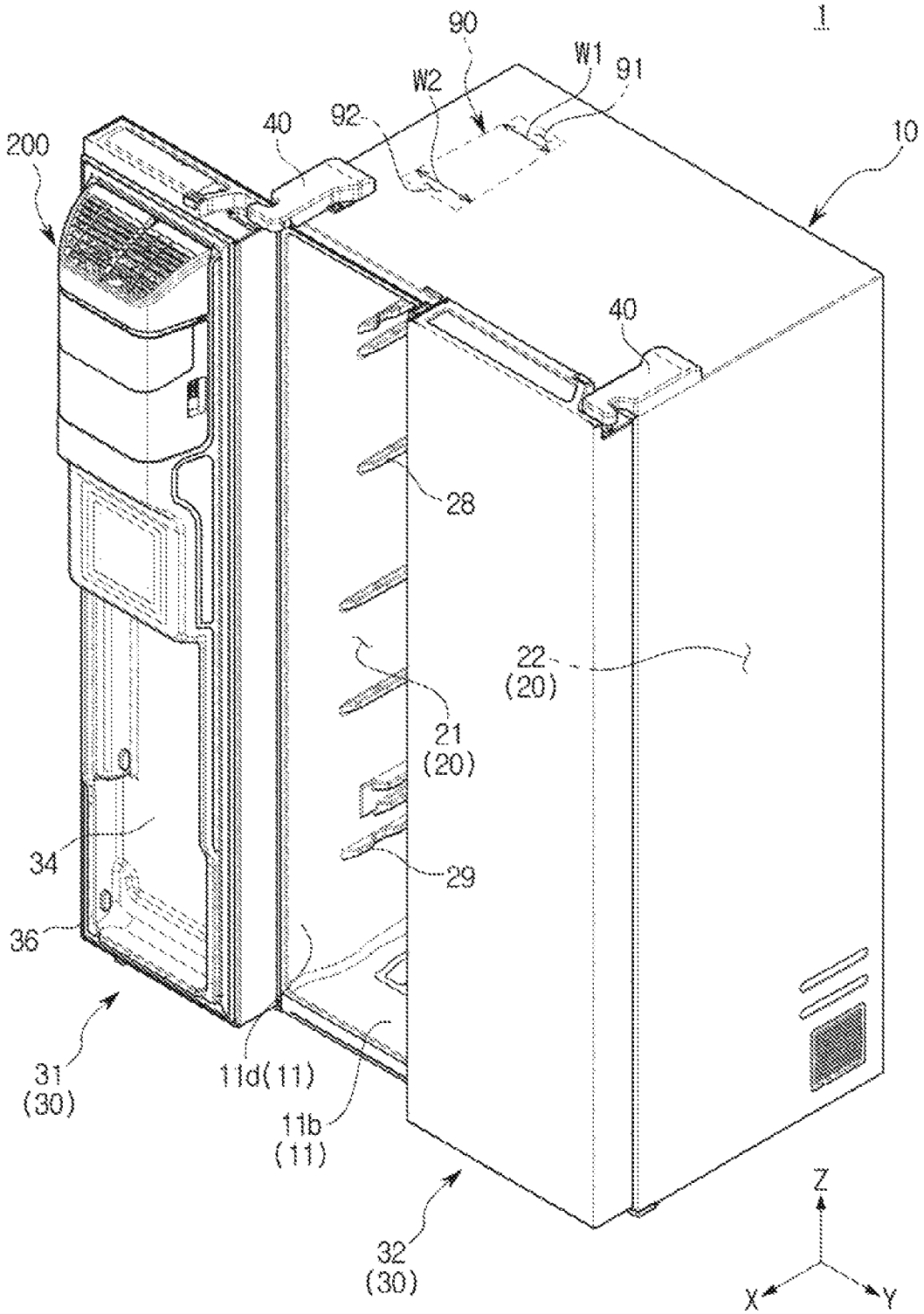
FIG. 2 illustrates a state in which a freezing chamber door is opened in the refrigerator according to an embodiment of the present disclosure.
Figure 3:
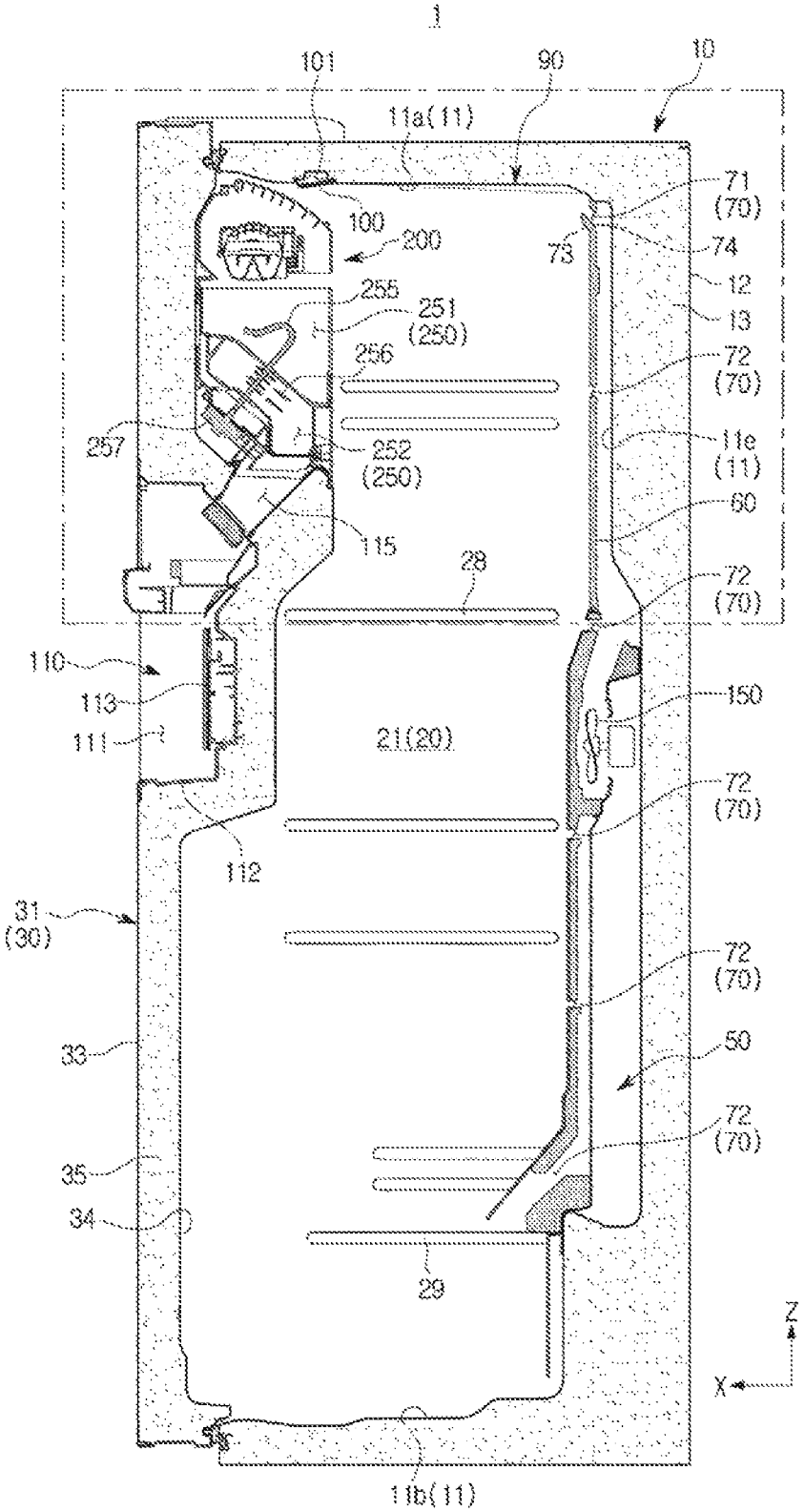
FIG. 3 is a cross-sectional view taken along line C-C' indicated in the refrigerator of FIG. 1.

FIG. 1 is a perspective view of a refrigerator according to an embodiment of the present disclosure, and FIG. 2 illustrates a state in which a freezing chamber door is opened in the refrigerator according to an embodiment of the present disclosure. FIG. 3 is a cross-sectional view taken along line C-C' indicated in the refrigerator of FIG. 1. In FIG. 2, "w1" refers to a width of a first end 91 of a guide passage 90, and "w2" refers to a width of a second end 92 of the guide passage 90.

As illustrated in FIGS. 1 to 3, the refrigerator 1 may include a main body 10. The main body 10 may include an inner case 11 defining a storage compartment 20. The inner case 11 may include an upper wall 11*a*, a lower wall 11*b*, a right wall 11*c* (see FIG. 11), a left wall 11*d*, and a rear wall 11*e*. The main body 10 may further include an outer case 12 coupled to an outer side of the inner case 11. The outer case 12 may be coupled to the outer side of the inner case 11 to form an outer appearance of the refrigerator 1. The main body 10 may further include an insulator 13 provided between the inner case 11 and the outer case 12 to insulate the storage compartment 20. The inner case 11 may be formed by injecting a plastic material, and the outer case 12 may be formed of a metal material. A urethane foam insulator (urethane foam insulation) may be used as the insulator 13, and a vacuum insulator (vacuum insulation panel) may be used together as needed.

The refrigerator 1 may further include a storage compartment 20 formed in the inner case 11. The storage compartment 20 may have an open front to allow food to be taken out of or put into the storage compartment 20. The storage compartment 20 may include a refrigerating chamber 22 and a freezing chamber 21. As an example, the right storage compartment may be used as the refrigerating chamber 22 for storing food in a refrigerating mode by maintaining indoor air at a temperature of about 0 to 5 degrees Celsius, and the left storage compartment may be used as the freezing chamber 21 for storing food in a freezing mode by maintaining indoor air at a temperature of about 0 to −30 degrees Celsius.

The storage compartment 20 may be provided with a shelf (not shown) on which food may be placed, and a drawer (not shown) that is pulled out of the storage compartment 20 or drawn into the storage compartment 20 in a sliding manner. The shelf may be supported by support bars 28 formed on the right wall 11*c* and the left wall 11*d* of the inner case 11, and the drawer may be slidably coupled to guide rails 29 formed on the right wall 11*c* and the left wall 11*d*.

The refrigerator 1 may further include a door 30 to open and close the storage compartment 20. The door 30 may be provided in the front of the storage compartment 20. Specifically, the door 30 may be provided rotatably to open and close the open front of the storage compartment 20. The door 30 may include a refrigerating chamber door 32 to open and close the refrigerating chamber 22 and a freezing chamber door 31 to open and close the freezing chamber 21. The refrigerating chamber door 32 may be rotatably coupled to the main body 10 to open and close the refrigerating chamber 22, and the freezing chamber door 31 may be rotatably coupled to the main body 10 to open and close the freezing chamber 21. The refrigerating chamber door 32 and the freezing chamber door 31 may be rotatably coupled to the main body 10 by a hinge member 40, respectively.

The door 30 may include a front plate 33 and a rear plate 34 coupled to the rear of the front plate 33. The front plate 33 of the door 30 may form the outer appearance of the refrigerator 1 together with the outer case 12 of the main body 10. Specifically, the front plate 33 of the door 30 may form a front appearance of the refrigerator 1. The rear plate 34 of the door 30 may define a rear surface of the door 30. The door 30 may further include an insulator 35 provided between the front plate 33 and the rear plate 34. Like the insulator 13 of the main body 10, a urethane foam insulator (urethane foam insulation) may be used as the insulator 35. and a vacuum insulator (vacuum insulation panel) may be used together as needed. An ice making chamber 200 may be insulated by the insulator 35 of the door 30.

A gasket 35, which is in close contact with a front surface of the main body 10 to seal the storage compartment 20, may be provided at the rear surface of the door 30.

The refrigerator 1 may further include the ice making chamber 200 provided at the door 30. The ice making chamber 200 may be provided on the rear surface of the door 30. A detailed description of the ice making chamber 200 will be described later.

The refrigerator 1 may further include a cold air supply device to supply cold air to the storage compartment 20 and the ice making chamber 200. The cold air supply device may generate cold air by using evaporative latent heat of a refrigerant. The cold air supply device may include an evaporator (not shown), a compressor (not shown), a condenser (not shown), and an expansion device (not shown). The cold air generated in the evaporator may be supplied to the storage compartment 20 and the ice making chamber 200 by an operation of a blowing fan 150.

The refrigerator 1 may further include a cold air supply duct 50 in which the cold air supply device is accommodated. The cold air supply duct 50 may be defined by the rear wall 11*e* of the inner case 11 and a duct cover 60. That is, the duct cover 60 may be coupled to the rear wall 11*e* of the inner case 11 to form the cold air supply duct 50 in which the cold air supply device is accommodated. A rear wall of the storage compartment 20 may be formed by the duct cover 60. A left wall, a right wall, an upper wall and a lower wall of the storage compartment 20 may be formed by the left wall 11*d*, the right wall 11*c*, the upper wall 11*a* and lower wall 11*b* of the inner case 11, respectively.

The refrigerator 1 may further include a cold air inlet 70 through which cold air generated in the cold air supply device is introduced into the storage compartment 20. The cold air inlet 70 may be formed on the duct cover 60. The cold air supply duct 50 and the storage compartment 20 may be communicated with each other by the cold air inlet 70. Preferably, the refrigerator 1 may include a plurality of the cold air inlets 70. The plurality of cold air inlets 70 may include a first cold air inlet 71 positioned at the uppermost end in the vertical direction Z of the refrigerator 1 and a plurality of second cold air inlets 72 positioned below the first cold air inlet 71 in the vertical direction Z of the refrigerator 1. Cold air introduced into the storage compartment 20 through the first cold air inlet 71 may move along the guide passage 90 and be introduced into the ice making chamber 200. The first cold air inlet 71 may be formed on the duct cover 60 to be adjacent to the upper wall 11*a* of the inner case 11.

The duct cover 60 may include a protrusion 73 protruding toward the storage compartment 20. The cold air generated in the cold air supply device may move along a guide surface 74 of the protrusion 73 facing the rear wall 11*e* of the inner case 11 and be introduced into the storage compartment 20 through the first cold air inlet 71. The first cold air inlet 71 may be positioned above the protrusion 73. The guide surface 74 may include a first section protruding inward of the storage compartment 20 with respect to the duct cover 60 and a second section extending from the first section to be substantially parallel to the duct cover 60. The cold air generated in the cold air supply device may pass through the first section and the second section of the guide surface 74 in sequence and may be introduced into the storage compartment 20 through the first cold air inlet 71. The cold air introduced into the storage compartment 20 through the cold air inlet 70 may increase in temperature through heat exchange in a process of circulating through the ice making chamber 200 and the storage compartment 20 and may be discharged into the cold air supply duct 50 through a discharge port (not shown). The discharge port may be formed on the duct cover 60. Preferably, the discharge port may be formed on the duct cover 60 to be positioned below the cold air inlet 70 in the vertical direction Z of the refrigerator 1. The discharge port may have a grill shape. However, the shape of the discharge port is not limited to the above example and nay be variously changed.

The refrigerator 1 may further include the guide passage 90 to guide cold air generated in the cold air supply device to the ice making chamber 200. The guide passage 90 may be integrally formed with the inner case 11. The guide passage 90 may be formed by being recessed into the inner case 11. Specifically, the guide passage 90 may be formed by being recessed into the upper wall 11*a* of the inner case 11. The guide passage 90 may be formed by being recessed into the upper wall 11*a* of the inner case 11 to be exposed to the storage compartment 20. That is, the guide passage 90 may be formed by being recessed into the upper wall 11*a* of the inner case 11 to be exposed to the freezing chamber 21. The guide passage 90 may include the first end 91 positioned upstream and the second end 92 positioned downstream, in a direction in which cold air introduced into the storage compartment 20 through the first cold air inlet 71 moves. The second end 92 of the guide passage 90 may have a smaller depth than the first end 91. Specifically, a depth of the guide passage 90 may decrease from the first end 91 of the guide passage 90 toward the second end 92 (see FIG. 4). The second end 92 of the guide passage 90 may have a larger width than the first end 91. Specifically, a width of the guide passage 90 may increase from the first end 91 of the guide passage 90 toward the second end 92.

The refrigerator 1 may further include a guide member to guide cold air moving along the guide passage 90. The guide member may be provided on the upper wall 11*a* of the inner case 11. The guide member may be positioned on a downstream side of the second end 92 of the guide passage 90 in the direction in which cold air introduced through the first cold air inlet 71 moves. The guide member may include an illumination device 100, which will be described later. That is, the illumination device 100, which will be described later, may serve to guide cold air moving along the guide passage 90 to the ice making chamber 200. However, the type of the guide member is not limited to the illumination device 100.

The refrigerator 1 may further include the illumination device 100 to illuminate the storage compartment 20. The illumination device 100 may operate to illuminate the storage compartment 20 when the storage compartment 20 is opened by the door 30. The illumination device 100 may be installed on the upper wall 11*a* of the inner case 11. Specifically, the illumination device 100 may be mounted on an illumination device installation portion 101 formed on the upper wall 11*a* of the inner case 11. More specifically, the illumination device 100 may be mounted on the illumination device installation portion 101 formed on the upper wall 11*a* of the inner case 11 in a state of being coupled to an illumination device frame. The illumination device 100 may be installed on the upper wall 11*a* of the inner case 11 to be positioned between the guide passage 90 and the ice making chamber 200, The illumination device 100 may, together with the guide passage 90, guide cold air introduced through the first cold air inlet 71 to the ice making chamber 200. Specifically, the illumination device 100 may include a first end facing the front of the refrigerator and a second end facing the rear of the refrigerator 1. The illumination device 100 may be mounted on the illumination device installation portion 101 such that the first end of the illumination device 100 protrudes further toward the storage compartment 20 than the second end of the illumination device 100. In other words, the illumination device 100 may include a light emitting surface 100*a* (see FIG. 8) inclined toward the ice making chamber 200 with respect to the upper wall 11*a* of the inner case 11 so that cold air moves along the light emitting surface 100*a*. The cold air passed through the guide passage 90 may pass through the second end and the first end of the illumination device 100 in order and be introduced into the ice making chamber 200.

The refrigerator ay further include a dispenser 110 to provide water and ice to a user. The dispenser 110 may be provided on the freezing chamber door 31. The dispenser 110 may include a dispensing space 111 recessed to receive water and ice, a dispensing tray 112 provided in the dispensing space 111 to allow a container such as a cup to be placed, and a dispensing switch 113 to input an operation command of the dispenser 110.

Figure 4:
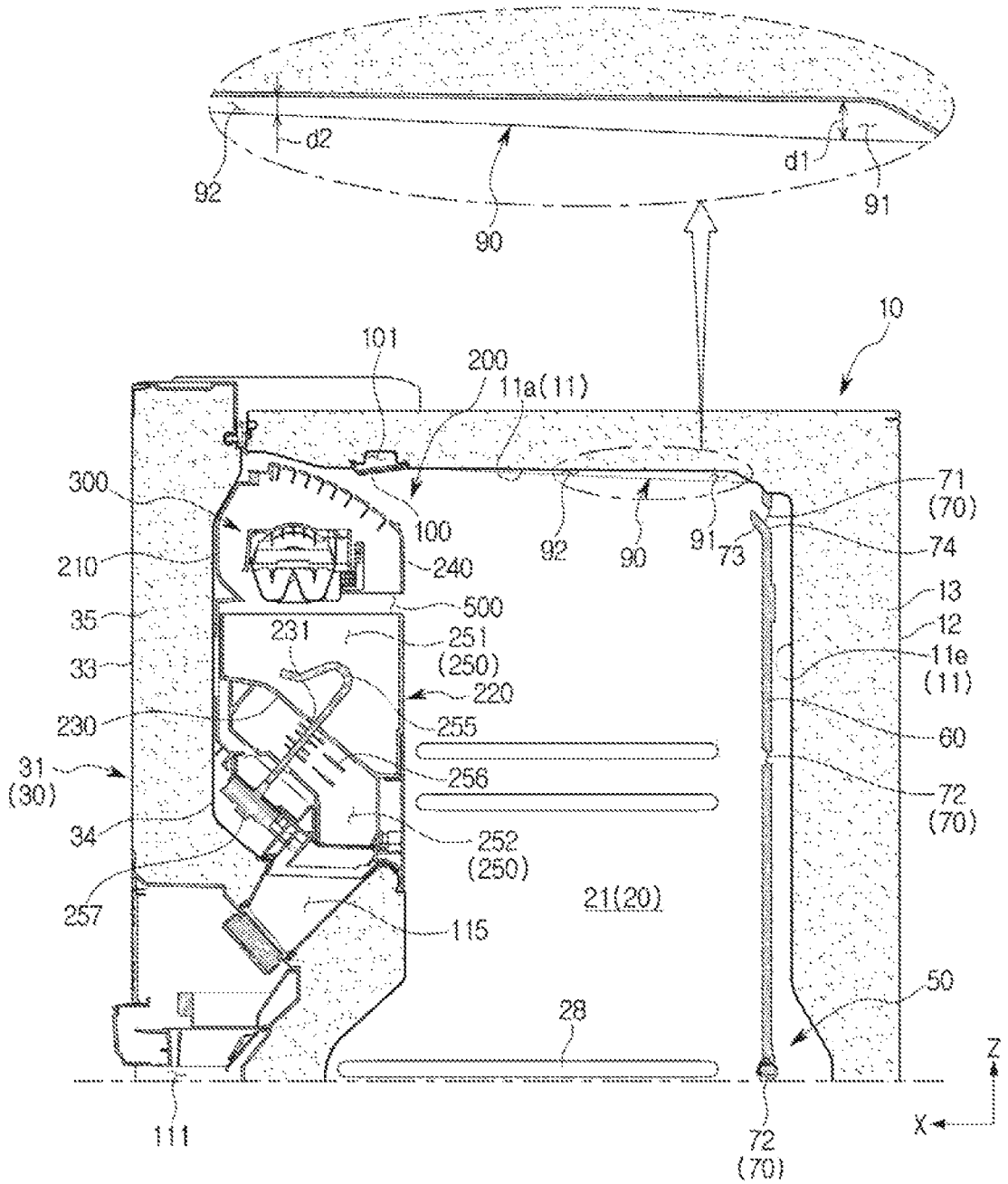
FIG. 4 is an enlarged view of one part of FIG. 3.
Figure 5:
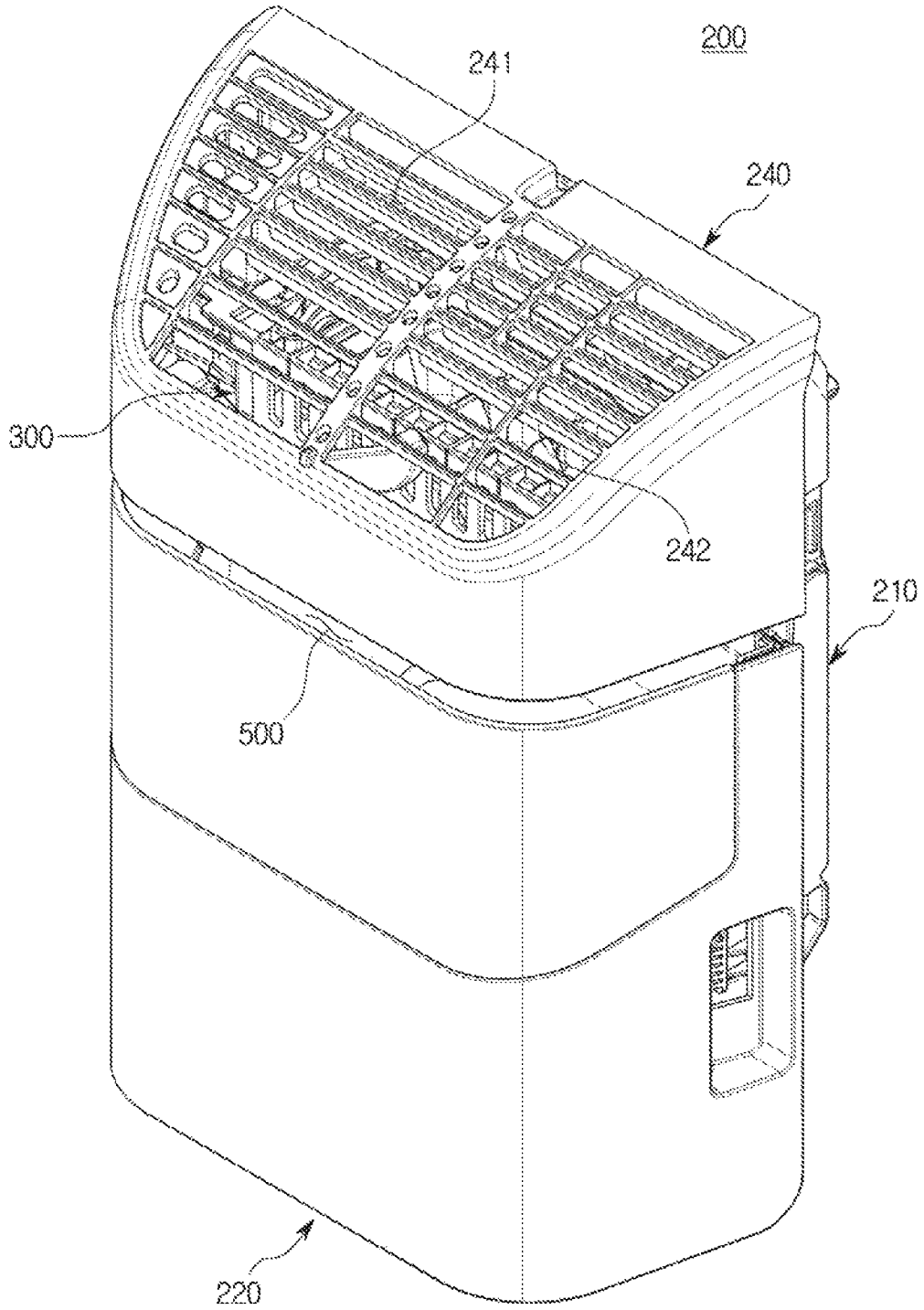
FIG. 5 is a perspective view of an ice making chamber in the refrigerator according to an embodiment of the present disclosure.
Figure 6:
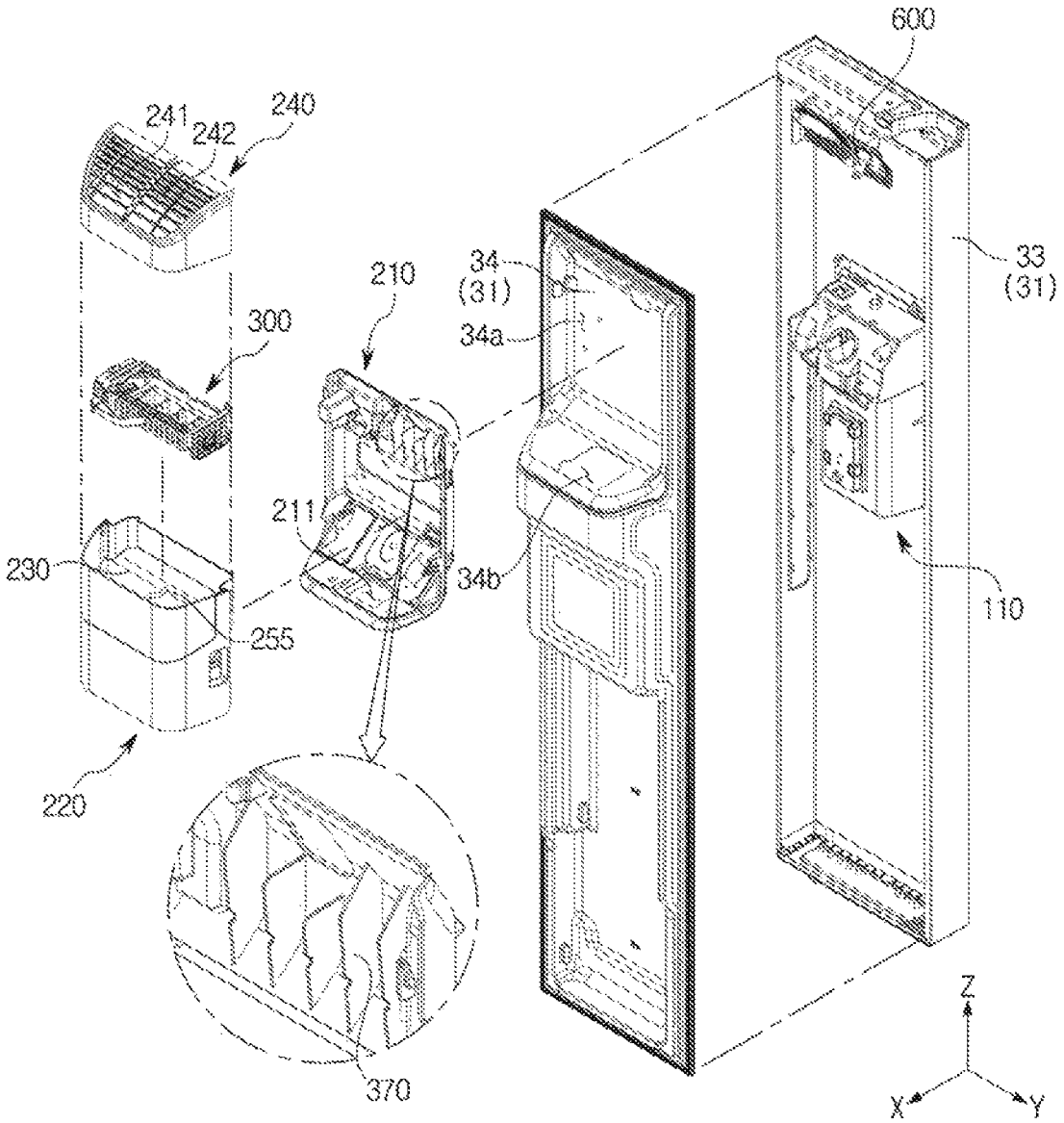
FIG. 6 is an exploded perspective view of the freezing chamber door and the ice making chamber in the refrigerator according to an embodiment of the present disclosure.
Figure 7:
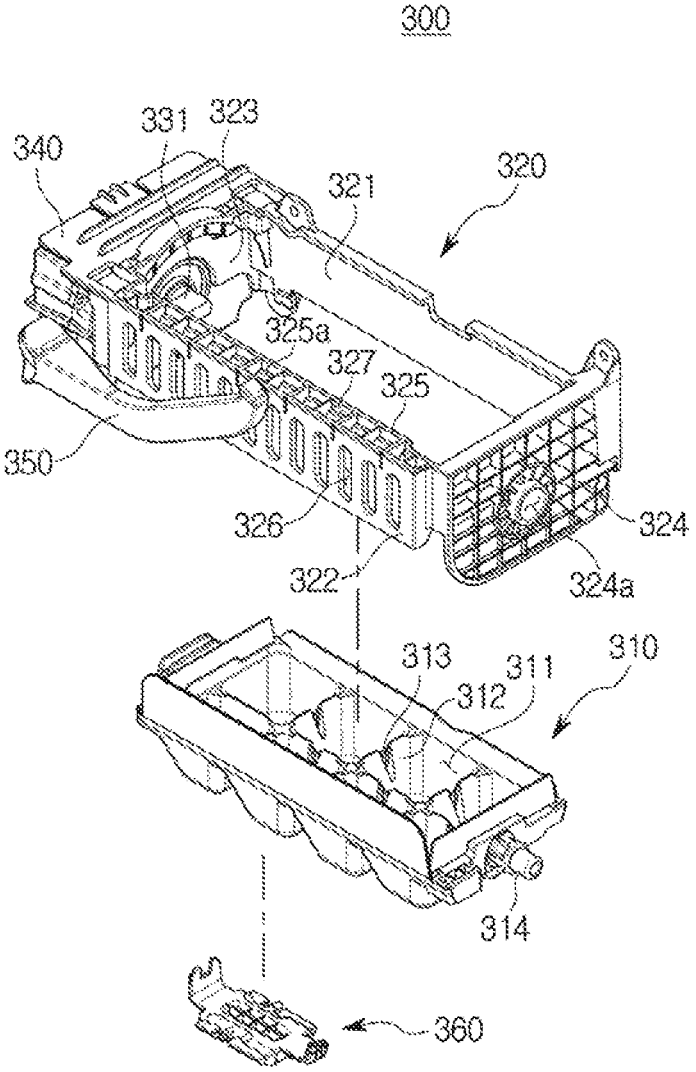
FIG. 7 is an exploded perspective view of an ice maker in the refrigerator according to an embodiment of the present disclosure.
Figure 8:
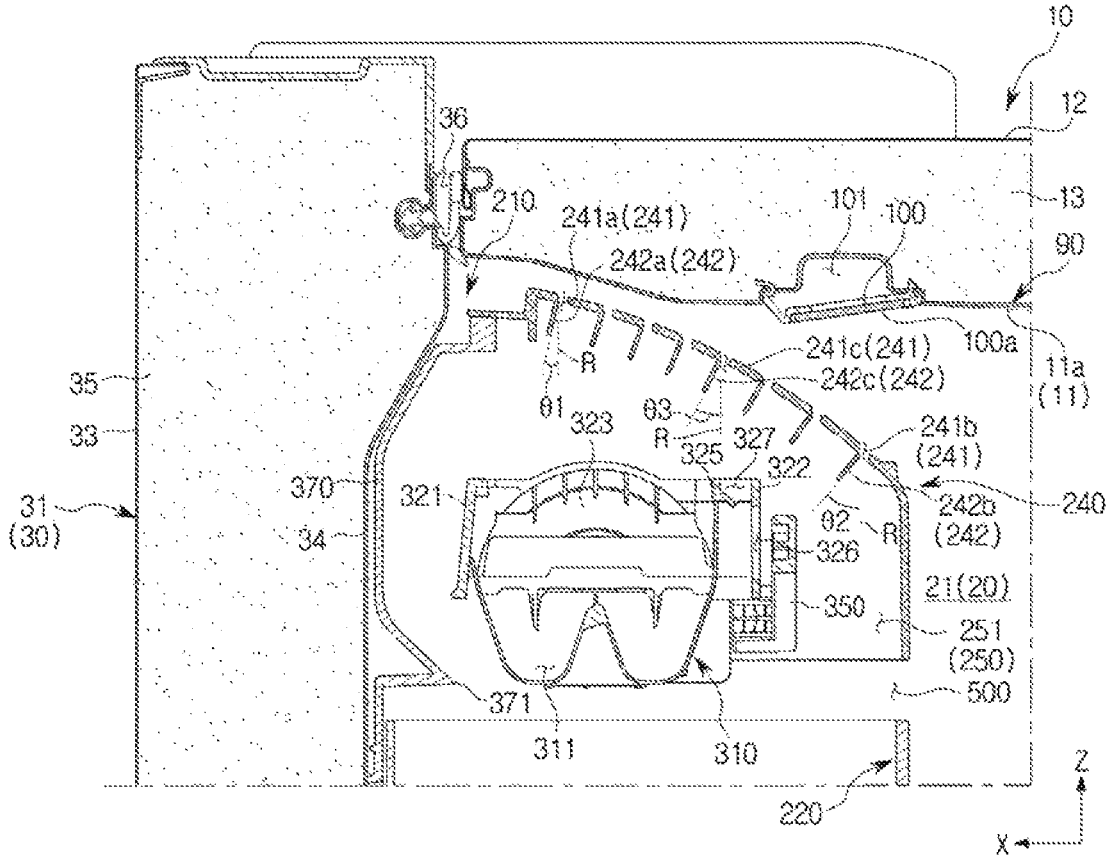
FIG. 8 is an enlarged view of the other part of FIG. 3.

FIG. 4 is an enlarged view of one part of FIG. 3, and FIG. 5 is a perspective view of an ice making chamber in the refrigerator according to an embodiment of the present disclosure. FIG. 6 is an exploded perspective view of the freezing chamber door and the ice making chamber in the refrigerator according to an embodiment of the present disclosure, and FIG. 7 is an exploded perspective view of an ice maker in the refrigerator according to an embodiment of the present disclosure. FIG. 8 is an enlarged view of the other part of FIG. 3. In FIG. 4, "d1" refers to a depth of the first end 91 of the guide passage 90, and "d2" refers to a depth of the second end 92 of the guide passage 90. Hereinafter, contents overlapping with those described with reference to FIGS. 1 to 3 will be omitted.

As illustrated in FIGS. 4 to 8, the ice making chamber 200 may include an ice making frame 210 coupled to the rear plate 34 of the door 30. In other words, the rear plate 34 of the door 30 may include an ice making chamber seating portion 34*a*, and the ice making frame 210 may be fixedly coupled to the ice making chamber seating portion 34*a*.

The ice making chamber 200 may further include an ice making casing 220 coupled to at least one of the ice making frame 10 and the rear plate 34 of the door 30 so that a predetermined space is provided therein. Preferably, the ice making casing 220 may be coupled to the ice making frame 210 so that a predetermined space is provided therein.

The ice making chamber 200 may further include an ice making chamber cover 240 coupled to at least one of the ice making frame 210 and the rear plate 34 of the door 30 to be positioned above the ice making casing 220. Preferably, the ice making chamber cover 240 may be coupled to the ice making frame 210 to be positioned above the ice making casing 220. The ice making chamber cover 240 may be positioned above the ice making casing 220 to be spaced apart from the ice making casing 220 in the vertical direction Z of the refrigerator 1. That is, a lower end of the ice making chamber cover 240 and an upper end of the ice making casing 220 maybe spaced apart from each other in the vertical direction Z of the refrigerator 1. Cold air introduced into the ice making chamber 200 may flow out into the storage compartment 20 through a gap between the ice making chamber cover 240 and the ice making casing 220. In other words, the ice making chamber cover 240 and the ice making casing 220 may be spaced apart from each other in the vertical direction Z of the refrigerator 1 to define a cold air outlet 500. The cold air introduced into the ice making chamber 200 may be discharged into the storage compartment 20 through the cold air outlet 500 and circulate.

The ice making chamber cover 240 may form an outer appearance of the ice making chamber 200 together with the ice making casing 220. That is, when the door 30 is opened, the ice making chamber cover 240 may, together with the ice making casing 220, form the outer appearance of the ice making chamber 200 exposed to the outside of the main body 10.

The ice making chamber cover 240 may include a plurality of cold air inflow slits 241 such that cold air moving along the upper wall 11*a* of the inner case 11 is introduced into the ice making chamber 200. The ice making chamber cover 240 may further include a plurality of partition ribs 242 to partition the plurality of cold air inflow slits 241. Cold air passed through the plurality of cold air inflow slits 241 may be discharged to the cold air outlet 500 through an ice making space 251.

The plurality of partition ribs 242 may include at least one first partition rib 242*a* disposed adjacent to the door 30. The plurality of partition ribs 242 may further include at least one second partition rib 242*b* disposed adjacent to the storage compartment 20 when the door 30 is closed. The plurality of partition ribs 242 may further include at least one third partition rib 242*c* disposed between the at least one first partition rib 242*a* and the at least one second partition rib 242*b*.

As illustrated in FIG. 8, the plurality of partition ribs 242 may be disposed to be inclined. Specifically, the plurality of partition ribs 242 may be inclined toward the door 30 with respect to a reference line R passing through an upper end of the plurality of partition ribs 242 and extending in the vertical direction Z of the refrigerator 1.

Inclination angles of the plurality of partition ribs 242 may be different. Specifically, inclination angles of at least one first partition rib 242*a*, at least one second partition rib 242*b*, and at least one third partition rib 242*c* may be different from each other.

An inclination angle θ2 of the at least one second partition rib 242*b* may be larger than an inclination angle θ1 of the at least one first partition rib 242*a* and an inclination angle θ3 of the at least one third partition rib 242*c*. The inclination angle θ1 of the at least one first partition rib 242*a* may be smaller than the inclination angle θ2 of the at least one second partition rib 242*b* and the inclination angle θ3 of the at least one third partition rib 242*c*.

The plurality of cold air inflow slits 241 may include at least one first cold air inflow slit 241*a* defined by the at least one first partition rib 242*a*. The plurality of cold air inflow slits 241 may further include at least one second cold air inflow slit 241*b* defined by the at least one second partition rib 242*b*. The plurality of cold air inflow slits 241 may further include at least one third cold air inflow slit 241*c* defined by the at least one third partition rib 242*c*. Cold air introduced into the ice making space 251 through the at least one first cold air inflow slit 241*a* is mainly delivered to a first cold air passage 410. Cold air introduced into the ice making space 251 through the at least one second cold air inflow slit 241*b* is mainly delivered to at least one of a plurality of cold air flow holes 327 and a plurality of cold air movement holes 326. Cold air introduced into the ice making space 251 through the at least one third cold air inflow slit 241*c* is mainly delivered to water stored in an ice making tray 310.

The ice making chamber 200 may further include an inner space 250 defined by the ice making frame 210, the ice making chamber cover 240 and the ice making casing 220. The inner space 250 may include the ice making space 251 in which ice is generated and stored, and an ice movement space 252 positioned below the ice making space 251 in the vertical direction Z of the refrigerator 1. Ice generated by an ice maker 300 may be accumulated on the bottom of the ice making space 251 and stored in the ice making space 251. The inner space 250 may be partitioned into the ice making space 251 and the ice movement space 252 by a partition plate 230. A discharge opening 231 may be formed on the partition plate 230 to allow ice generated in the ice making space 251 to move to the ice movement space 252. The ice movement space 252 may be defined by the ice making casing 220, the partition plate 230 and the ice making frame 210. When the ice making casing 220 defines a front wall and opposite side walls of the ice movement space 252, the ice making frame 210 may define a rear wall and a lower wall of the ice movement space 252, and the partition plate 230 may define an upper wall of the ice movement space 252. An opening 211 may be formed on a portion of the ice making frame 210 defining the lower wall of the ice movement space 252 to allow ice in the ice movement space 252 to be discharged. Ice discharged from the ice movement space 252 may be supplied to the dispensing space 111 through a chute 115. Specifically, ice passed through the opening 211 and an opening 34*b* formed on the rear plate 34 of the door 30 to correspond to the opening 211 in order may be supplied to the dispensing space 111 through the chute 115.

A rotatable transfer member 255 to stir and transfer ice and a crushing blade 256 to crush ice may be provided in the ice movement space 252. The transfer member 255 may be operated by being connected to a transfer motor 257. A portion of the transfer member 255 may pass through the discharge opening 231 of the partition plate 230 and may be disposed inside the ice making space 251.

The refrigerator 1 may further include the ice maker 300 disposed inside the ice making chamber 200. Specifically, the ice maker 300 may be disposed in the ice making space 251.

The ice maker 300 may include the ice making tray 310 having an ice making cell 311 capable of storing water. The ice making tray 310 may be formed of a plastic material.

The ice making tray 310 may include a plurality of the ice making cells 311, partitions 312 to partition the plurality of ice making cells 311 from each other, and passage grooves 313 formed on the partitions 313 to allow water to flow between the partitions 312, Water supplied from a water supply pipe 600 may be stored in the ice making cells 311, and the water stored in the ice making cells 311 may be cooled by cold air circulating through the ice making space 251.

The ice maker 300 may further include a tray cover 320 coupled to an outer side of the ice making tray 310. The tray cover 320 may be coupled to the outer side of the ice making tray 310 to surround a side circumference of the ice making tray 310. In another aspect, the ice making tray 310 may be accommodated in the tray cover 320. The tray cover 320 may be fixedly coupled to the ice making frame 210.

The tray cover 320 may include a first wall 321 facing the ice making frame 210, a second wall 322 facing the first wall 321, a third wall 323 connecting the first wall 321 and the second wall 322, and a fourth wall 324 connecting the first wall 321 and the second wall 322 and facing the third wall 323. The plurality of cold air movement holes 326 may be formed on the second wall 322 of the tray cover 320. Cold air introduced into the plurality of cold air movement holes 326 may cool one wall of the ice making tray 310 facing the second wall 322 of the tray cover 320.

The tray cover 320 may further include an extension portion 325 extending in an inward direction of the tray cover 320 from an upper end of the second wall 322. In other words, the tray cover 320 may further include the extension portion 325 extending from the upper end of the second wall 322 toward the first wall 321 of the tray cover 320. The plurality of cold air flow holes 327 may be formed on the extension portion 325 of the tray cover 320. In addition, a guide portion 325*a* to guide cold air introduced into the plurality of cold air flow holes 327 may be formed on the extension portion 325 of the tray cover 320. Specifically, a plurality of the guide portions 325*a* corresponding to the plurality of cold air flow holes 327, respectively, may be formed on the extension portion 325 of the tray cover 320, and the plurality of guide portions 325*a* may be positioned inside the plurality of cold air flow holes 327. The plurality of guide portions 325*a* may include a guide surface inclined toward the second wall 322 of the tray cover 320 with respect to the vertical direction Z of the refrigerator 1. Cold air introduced into the plurality of cold air flow holes 327 moves along the guide surfaces of the plurality of guide portions 325*a* to cool one wall of the ice making tray 310 facing the second wall 322 of the tray cover 320.

The ice maker 300 may further include an ice separation motor (not shown) coupled to one end of the ice making tray 310 to separate ice from the ice making cells 311. Specifically, one end of the ice making tray 310 may be coupled to a motor shaft 331 of the ice separation motor. When the ice separation motor plates, ice cubes are separated from the ice making cells 311 of the ice making tray 310 as the ice making tray 310 is twisted. Specifically, the ice making tray 310 may include a first end facing the third wall 323 of the tray cover 320 and a second end facing the fourth wall 324 of the tray cover 320. A protrusion 314 extending in an outward direction of the ice making tray 310 may be formed at a second end of the ice making tray 310. The protrusion 314 may be fixedly coupled to a coupling hole 324*a* formed on the fourth wall 324 of the tray cover 320. The first end of the ice making tray 310 may be rotatably coupled to the motor shaft 331 of the ice separation motor. The first end of the ice making tray 310 rotates together with the motor shaft 331 of the ice separation motor, and the second end of the ice making tray 310 is fixedly coupled to the coupling hole 324*a*. of the tray cover 320, so that the ice making tray 310 is twisted when the ice separation motor operates. As such, as the ice making tray 310 is twisted, ice cubes may be separated from the ice making cells 311.

The ice maker 300 may further include a motor box 340 to accommodate the ice separation motor. The motor box 340 may protect the ice separation motor by accommodating the ice separation motor. The motor box 340 may be disposed adjacent to the third wall 323 of the tray cover 320. The motor box 340 may be supported on the ice making frame 210.

The ice maker 300 may further include a sensing lever 350 coupled to the motor box 340. The detection lever 350 may be provided to detect whether the ice making space 251 is fully filled with ice.

The ice maker 300 may further include a cooling detection sensor 360 to detect whether water stored in the ice making cell 311 is frozen. The cooling detection sensor 360 may be fixedly coupled to the bottom of the ice making tray 310.

A plurality of guide ribs 370 may be formed on the ice making frame 210. Specifically, the plurality of guide ribs 370 may be formed on a portion of the ice making frame 210 defining the ice making space 251. The plurality of guide ribs 370 may extend from the ice making frame 210 to face the first wall 321 of the tray cover 320. Each of the plurality of guide ribs 370 may include an end 371 facing downward in the vertical direction Z of the refrigerator 1. The end 371 of each of the plurality of guide ribs 370 may be positioned between an upper end and a lower end of the cold air outlet 500 in the vertical direction Z of the refrigerator 1.

Figure 9:
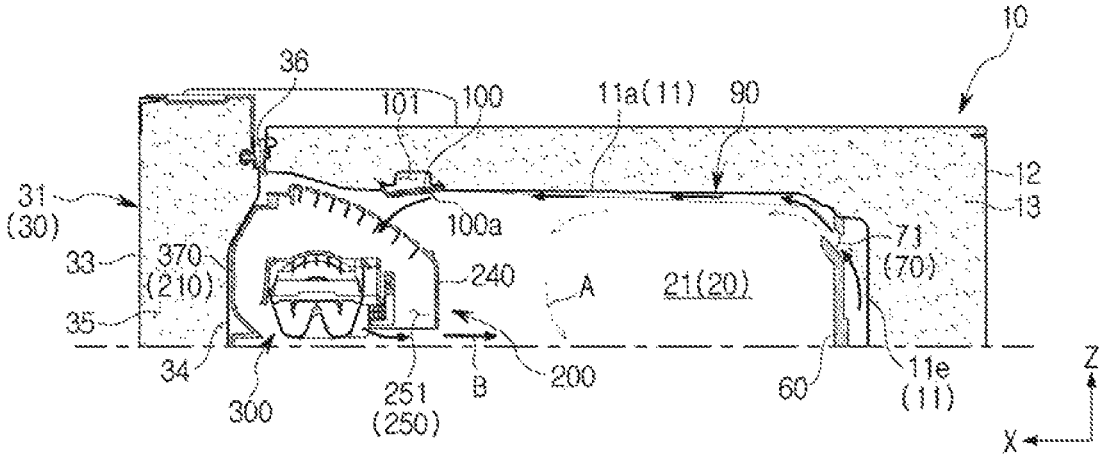
FIG. 9 illustrates a flow of cold air circulating through a storage compartment and the ice making chamber in the refrigerator according to an embodiment of the present disclosure.
Figure 10A:
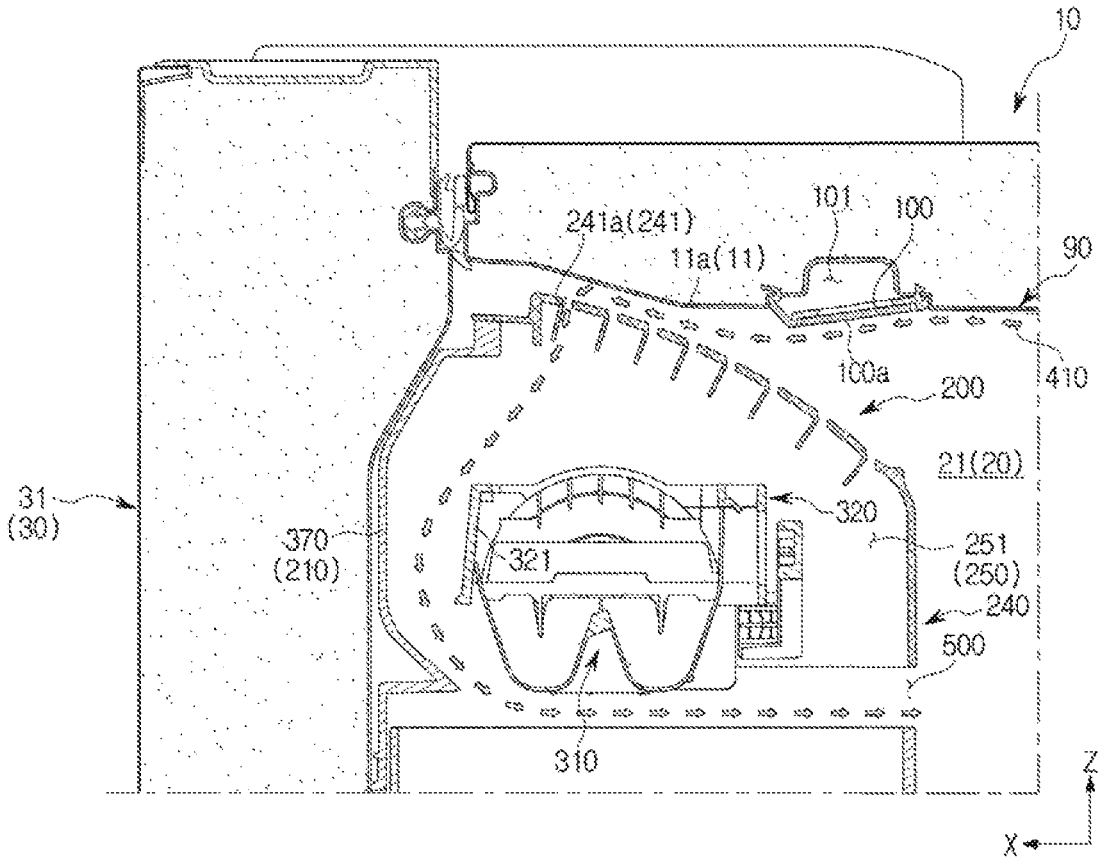
FIGS. 10A to 10C illustrate enlarged flows of cold air circulating through the ice making chamber in the refrigerator according to an embodiment of the present disclosure.
Figure 10B:
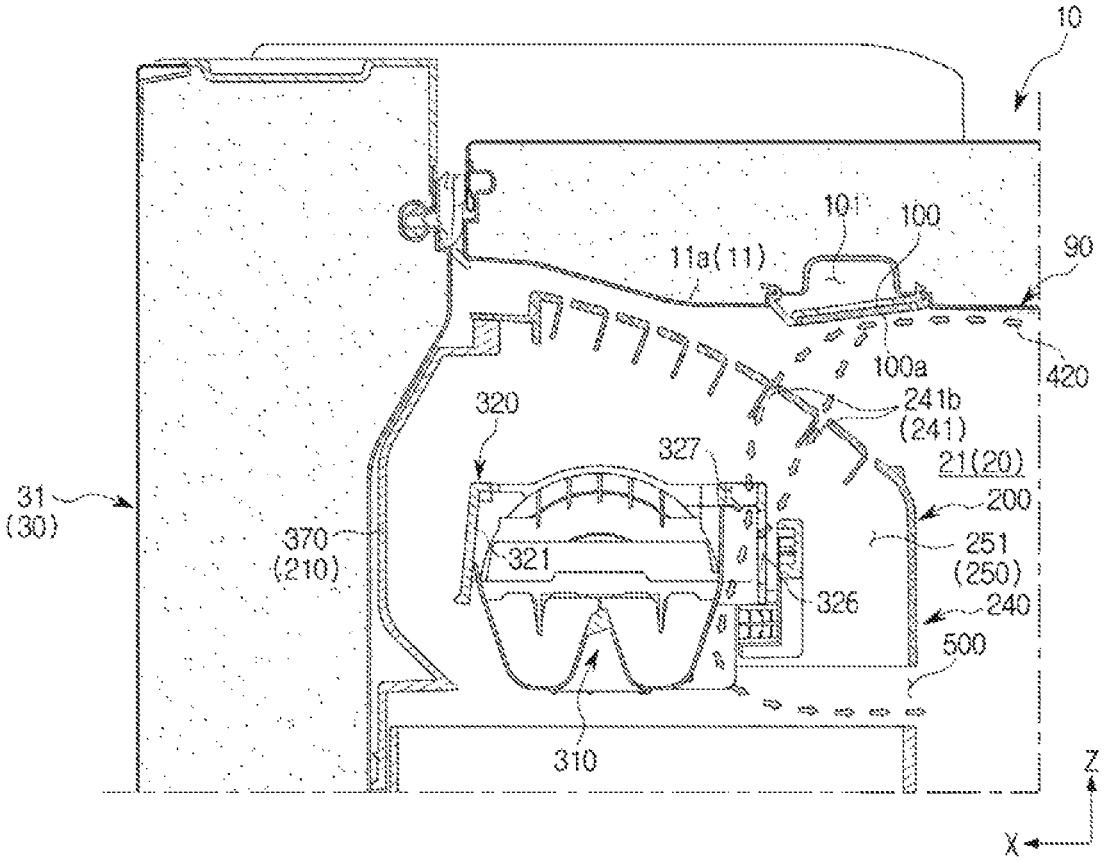
Figure 10C:
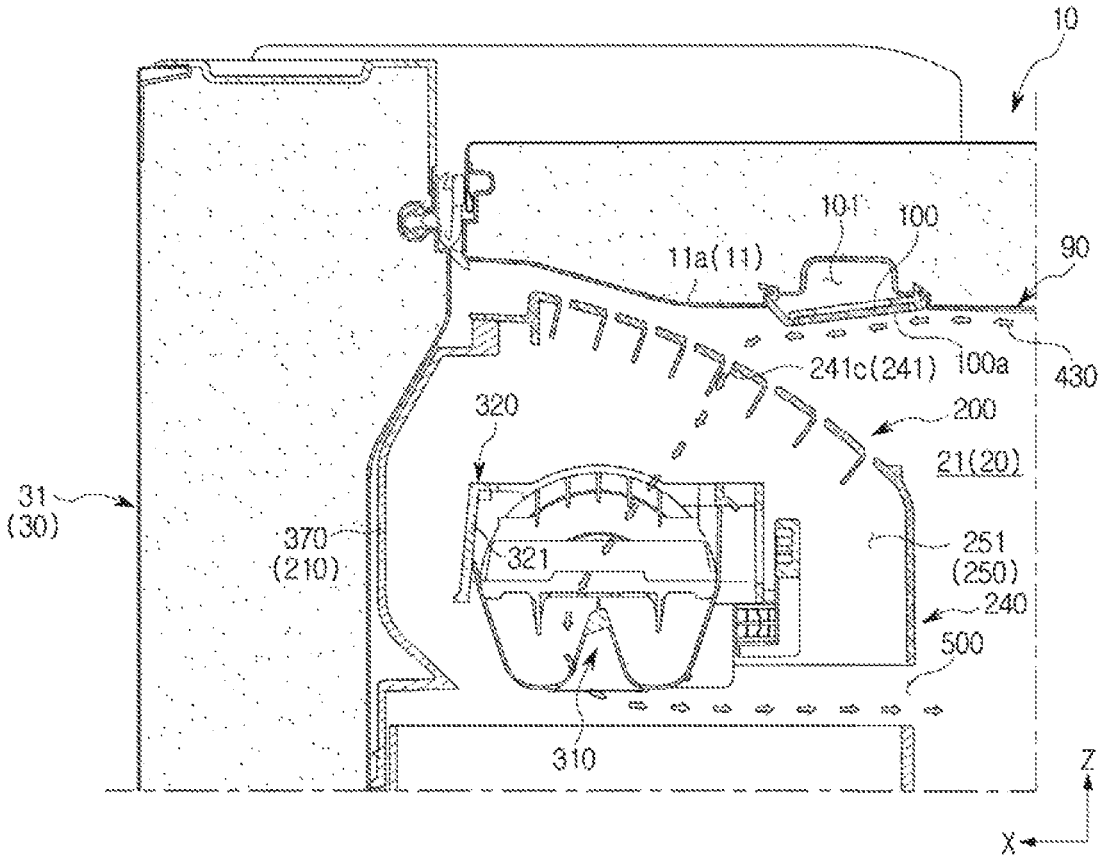

FIG. 9 illustrates a flow of cold air circulating through a storage compartment and the ice making chamber in the refrigerator according to an embodiment of the present disclosure, and FIGS. 10A to 10C illustrate enlarged flows of cold air circulating through the ice making chamber in the refrigerator according to an embodiment of the present disclosure in FIG. 9, "A" refers to a flow of cold air circulating through the storage compartment 20, and "B" refers to a flow of cold air circulating through the ice making chamber 200. Hereinafter, contents overlapping with those described with reference to FIGS. 1 to 8 will be omitted.

As illustrated in FIGS. 9 to 10C the refrigerator 1 may further include a cold air passage provided to pass through the ice making chamber 200.

The cold air passage may include a first cold air passage 410 defined by the plurality of guide ribs 370 to move a part of cold air introduced through the plurality of cold air inflow slits 241. Cold air introduced through mainly the at least one first cold air inflow slit 241*a* may move along the first cold air passage 410.

The first cold air passage 410 may include a first section 411 and a second section 412. The first section 411 may be positioned upstream in a direction in which cold air introduced through the plurality of cold air inflow slits 241 moves. The first section 411 may extend in the vertical direction Z of the refrigerator 1. The second section 412 may be positioned downstream in the direction in which cold air introduced through the plurality of cold air inflow slits 241 moves. The second section 412 may extend from the first section 411 to face the first wall 321 of the tray cover 320. The second section 412 may include an inclined surface. That is, the second section 412 may extend from the first section 411 to incline toward the first wall 321 of the tray cover 320.

Cold air moving along the first section 411 of the first cold air passage 410 may directly bring into contact with the first wall 321 of the tray cover 320. In other words, cold air moving along the first section 411 of the first cold air passage 410 may cool the first wall 321 of the tray cover 320. In another aspect, the first cold air passage 410 may be defined by the plurality of guide ribs 370 and the first wall 321 of the tray cover 320.

Cold air passed through the second section 412 of the first cold air passage 410 may directly bring into contact with an outer surface of the bottom of the ice making tray 310. In other words, cold air passed through the second section 412 of the first cold air passage 410 may cool the bottom of the ice making tray 310.

The cold air passage may further include a second cold air passage 420 to move another part of cold air introduced through the plurality of cold air inflow slits 241. Cold air introduced through mainly the at least one second cold air inflow slit 241*b* may move along the second cold air passage 420. The plurality of cold air movement holes 326 and the plurality of cold air flow holes 327 may be positioned on the second cold air passage 420. In other words, the second cold air passage 420 may pass through the plurality of cold air movement holes 326 and the plurality of cold air flow holes 327.

Cold air moving along the second cold air passage 420 may directly bring into contact with one wall of the ice making tray 310 facing the second wall 322 of the tray cover 320. In another aspect, the second cold air passage 420 may be formed between the second wall 322 of the tray cover 320 and one wall of the ice making tray 310 facing the second wall 322 of the tray cover 320.

The cold air passage may further include a third cold air passage 430 to move another part of cold air introduced through the plurality of cold air inflow slits 241. Cold air introduced through mainly the at least one third cold air inflow slit 241*c* may move along the third cold air passage 430.

Cold air moving along the first cold air passage 410, the second cold air passage 420, and the third cold air passage 430 may be discharged into the storage chamber 20 through the cold air outlet 500.

Hereinafter, a cold air flow will be described centering on the cold air introduced into the storage compartment 20 through the first cold air inlet 71. Cold air generated in the cold air supply device may be introduced into the storage compartment 20 through the first cold air inlet 71. Cold air passed through the first cold air inlet 71 is delivered to the guide passage 90. Cold air delivered to the guide passage 90 moves along the upper wall 11*a* of the inner case 11, that is, the guide passage 90 due to the Coanda effect. A part of cold air moving along the guide passage 90 circulates inside the storage compartment 20 to keep food stored inside the storage compartment 20 in a fresh state. The rest of cold air moving along the guide passage 90 is changed in direction by the illumination device 100 and introduced into the ice making chamber 200. Specifically, cold air is introduced into the ice making chamber 200 through a plurality of cold air inflow slits 241. Cold air introduced into the ice making space 251 through the first cold air inflow slit 241*a* moves along the first cold air passage 410 and is discharged into the storage compartment 20 through the cold air outlet 500. Cold air introduced into the ice making space 251 through the second cold air inflow slit 241*b* moves along the second cold air passage 420 and is discharged into the storage compartment 20 through the cold air outlet 500. Cold air introduced into the ice making space 251 through the third cold air inflow slit 241*c* moves along the third cold air passage 430 and is discharged into the storage compartment 20 through the cold air outlet 500.

As illustrated in FIGS. 9 to 10C, the first cold air passage 410, the second cold air passage 420, and the third cold air passage 430 may be formed to surround a circumference of the ice making tray 310. That is, a front surface of the ice making tray 310 may be cooled by cold air moving along each of the first cold air passage 410, the second cold air passage 420, and the third cold air passage 430. Of course, water stored in the ice making cells 311 of the ice making tray 310 may also be directly cooled by cold air. Specifically, water stored in the ice making cells 311 may be directly cooled by cold air moving along the third cold air passage 430.

As such, by designing cold air passages such that both the front surface of the ice making tray 310 and the water stored in the ice making cells 311 of the ice making tray 310 may be cooled, the ice making performance of the refrigerator 1 may be improved.

Figure 11:
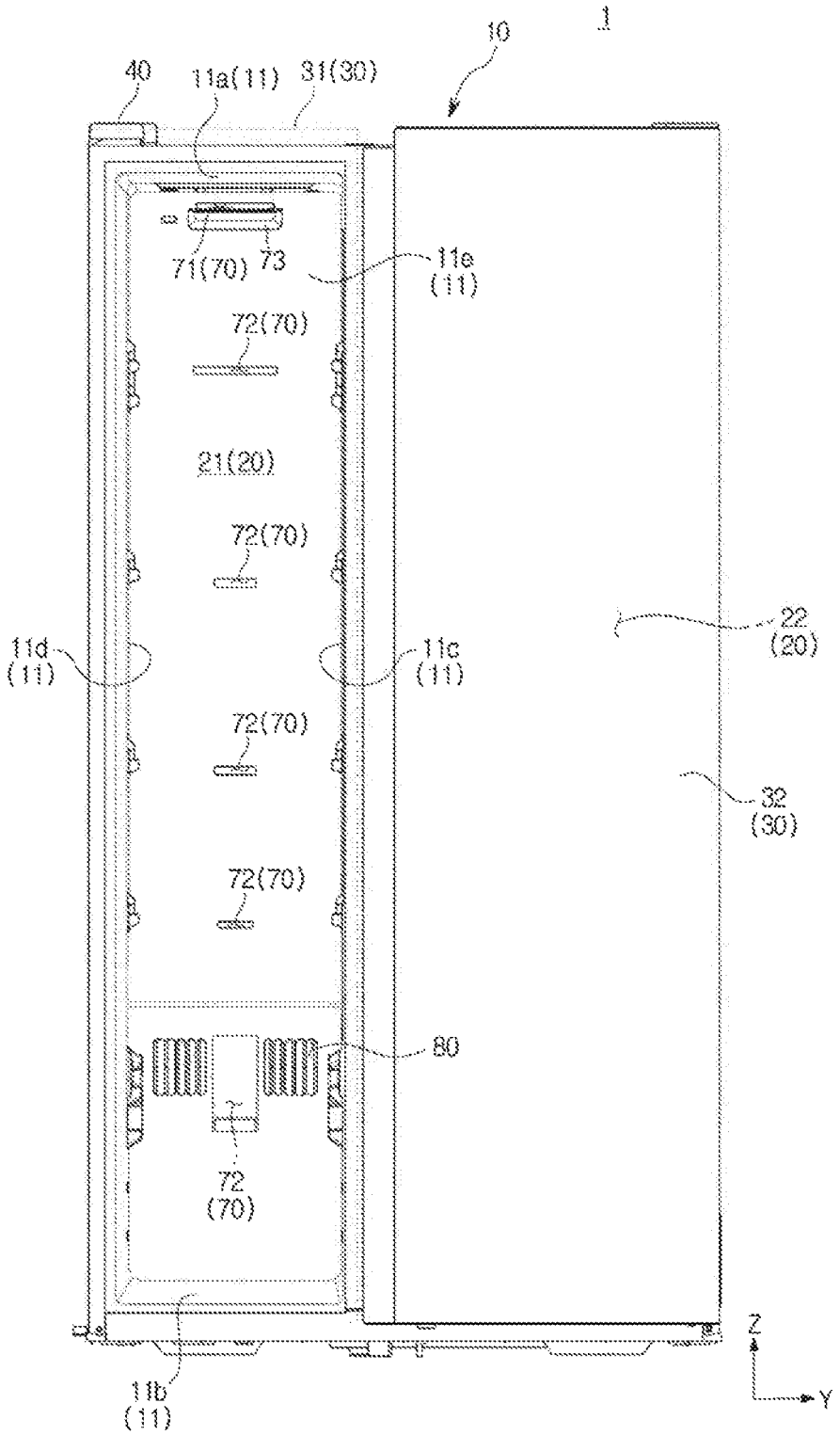
FIG. 11 illustrates a refrigerator according to another embodiment of the present disclosure.

FIG. 11 illustrates a refrigerator according to another embodiment of the present disclosure. Hereinafter, contents overlapping with those described with reference to FIGS. 1 to 10C will be omitted. In addition, the same reference numerals are assigned to the same components as those illustrated in FIGS. 1 to 10C.

As illustrated in FIG. 11, the inner case 11 may include the rear wall 11*e*. The cold air inlet 70 may be formed on the rear wall 11*e* of the inner case 11. In the case of the present embodiment, a front surface of the storage compartment 20 may be defined by the inner case 11. Specifically, the left wall, the right wall, the upper wall, the lower wall, and the rear wall of the storage compartment 20 may be formed by the left wall 11*d*, the right wall 11*c*, the upper wall 11*a*, the lower wall 11*b*, and the rear wall 11*e* of the inner case 11, respectively.

Cold air introduced into the storage compartment 20 through the cold air inlet 70 may increase in temperature through heat exchange in a process of circulating through the ice making chamber 200 and the storage compartment 20 and may be discharged into the outside of the storage compartment 20 through a discharge port 80. The discharge port 80 may be formed on the rear wall 11*e* of the inner case 11. Preferably, the discharge port 80 may be formed on the rear wall 11*e* of the inner case 11 to be positioned below the cold air inlet 70 in the vertical direction Z of the refrigerator 1. The discharge port 80 may have a grill shape. However, the shape of the discharge port 80 is not limited to the above example and may be variously changed.

Figure 12:
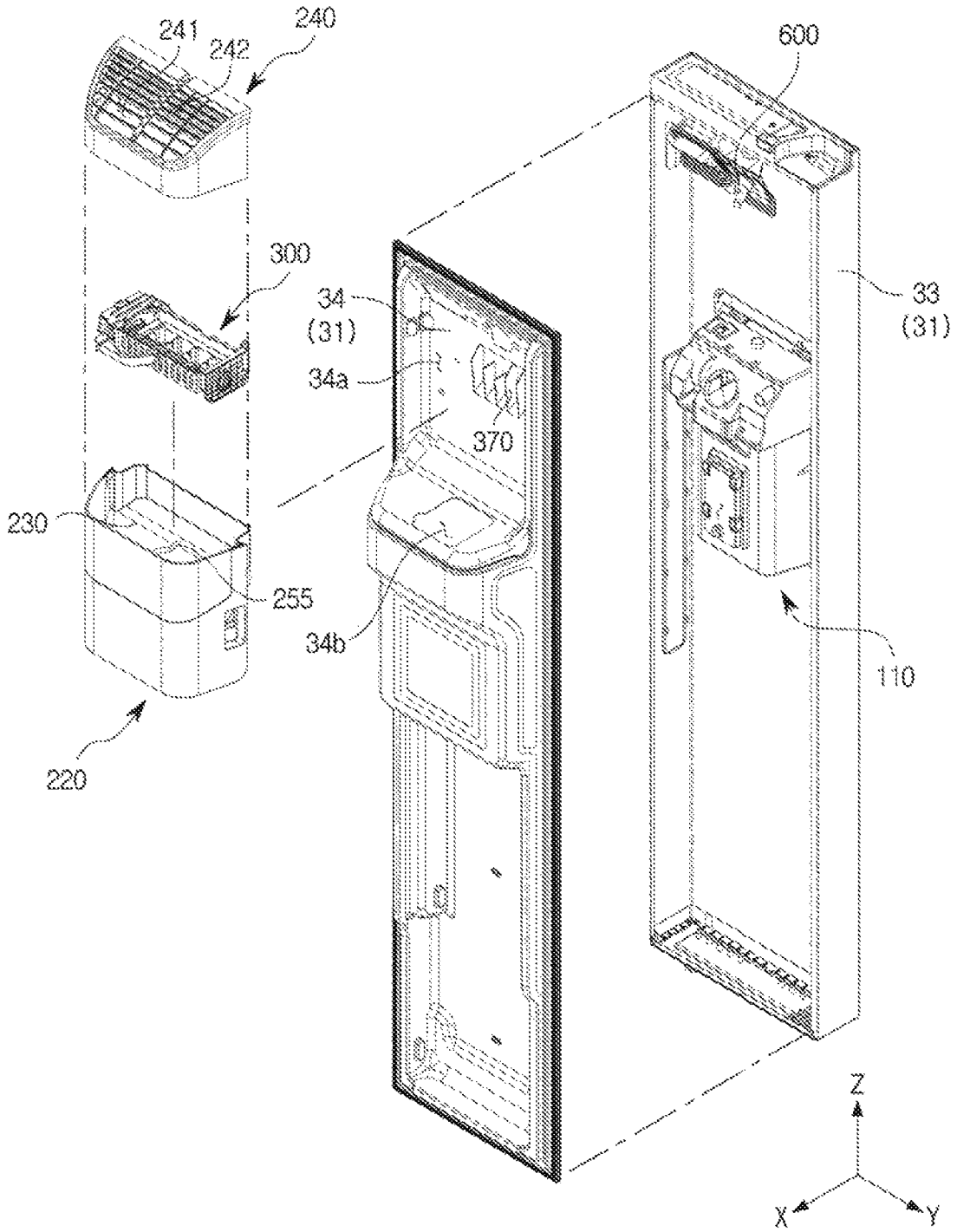
FIG. 12 is an exploded perspective view of a freezing chamber door and an ice making chamber in a refrigerator according to another embodiment of the present disclosure.

FIG. 12 is an exploded perspective view of a freezing chamber door and an ice making chamber in a refrigerator according to another embodiment of the present disclosure. Hereinafter, contents overlapping with those described with reference to FIGS. 1 to 10C will be omitted. In addition, the same reference numerals are assigned to the same components as those illustrated in FIGS. 1 to 10C.

FIG. 12 illustrates an embodiment in which the ice making frame 210 is removed. In this case, the plurality of guide ribs 370 may be formed on the rear plate 34 of the door 30. In other words, the plurality of guide ribs 370 may be formed on the ice making chamber seating portion 34*a* of the door 30. Hereinafter, the present embodiment will be described in detail.

As illustrated in FIG. 12, the ice making chamber 200 may include the ice making casing 220 coupled to the rear plate 34 of the door 30 so that a predetermined space is provided therein.

The ice making chamber 200 may further include the ice making chamber cover 240 coupled to the rear plate 34 of the door 30 to be positioned above the ice making casing 220.

The ice making chamber 200 may further include the inner space 250 defined by the rear plate 34 of the door 30, the ice making chamber cover 240, and the ice making casing 220. The inner space 250 may be partitioned into the ice making space 251 and the ice movement space 252 by the partition plate 230. The discharge opening 231 may be formed on the partition plate 230 to allow ice generated in the ice making space 251 to move to the ice movement space 252. The ice movement space 252 may be defined by the rear plate 34 of the door 30, the ice making casing 220 and the partition plate 230. When the ice making casing 220 defines the front wall and the opposite side walls of the ice movement space 252, the rear plate 34 of the door 30 may define the rear wall and the lower wall of the ice movement space 252 and the partition plate 230 may define the upper wall of the ice movement space 252. Ice in the ice movement space may pass through the opening 34*b* formed on the rear plate 34 of the door 30 and may be supplied to the dispensing space 111 through the chute 115.

The plurality of guide ribs 370 may be formed on the rear plate 34 of the door 30. Specifically, the plurality of guide ribs 370 may be formed on a portion of the rear plate 34 of the door 30 defining the ice making space 251. The plurality of guide ribs 370 may extend from the rear plate 34 of the door 30 to face the first wall 321 of the tray cover 320. The plurality of guide ribs 370 may be integrally formed with the rear plate 34 of the door 30. Also, the plurality of guide ribs 370 may be formed in a separate configuration from the rear plate 34 of the door 30 and may be fixedly coupled to the rear plate 34 of the door 30 by a fastening member.

Figure 13:
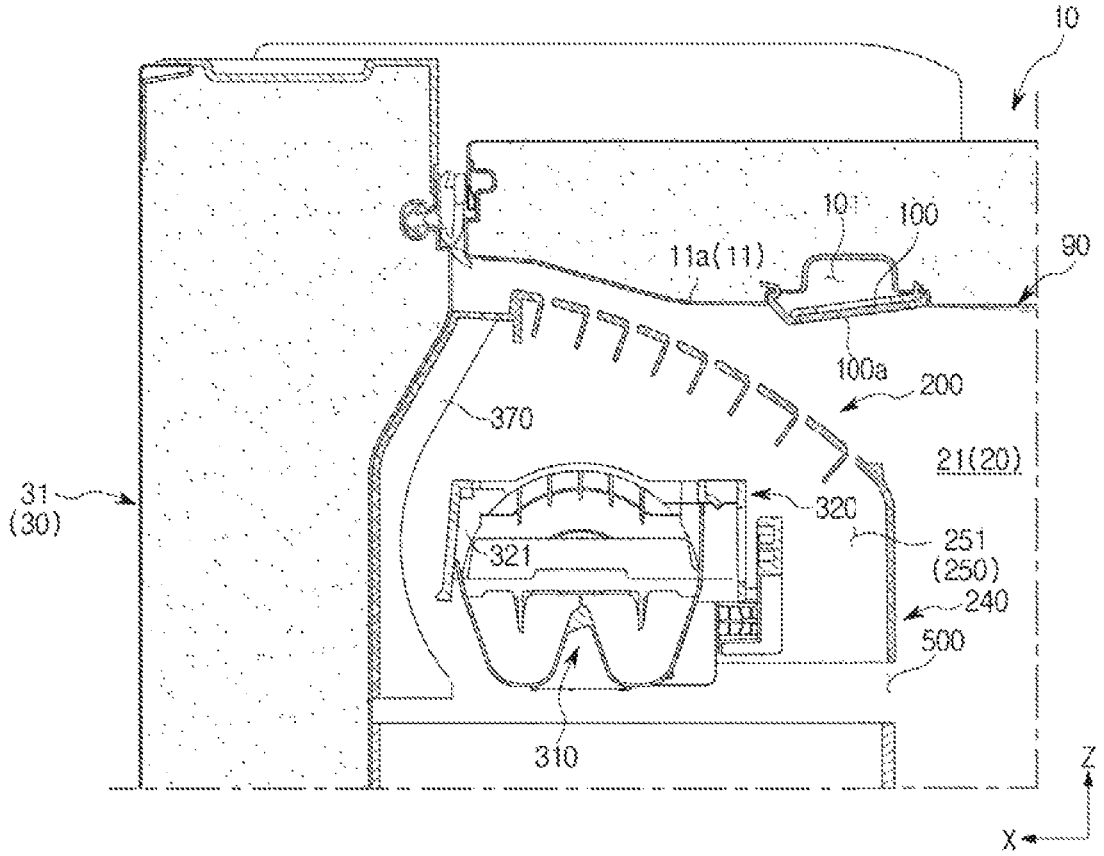
FIG. 13 is an enlarged cross-sectional view of a part of a refrigerator according to another embodiment of the present disclosure.

FIG. 13 is an enlarged cross-sectional view of a part of a refrigerator according to another embodiment of the present disclosure. Hereinafter, contents overlapping with those described with reference to FIGS. 1 to 10C will be omitted.

In addition, the same reference numerals are assigned to the same components as those illustrated in FIGS. 1 to 10C.

FIG. 13 illustrates an embodiment in which the ice making frame 210 is removed. In this case, the plurality of guide ribs 370 may be formed on the ice making chamber cover 240. Hereinafter, the present embodiment will be described in detail.

As illustrated in FIG. 13, the ice making chamber 200 may include the ice making casing 220 coupled to the rear plate 34 of the door 30 so that a predetermined space is provided therein.

The ice making chamber 200 may further include the ice making chamber cover 240 coupled to the rear plate 34 of the door 30 to be positioned above the ice making casing 220.

The ice making chamber 200 may further include the inner space 250 defined by the rear plate 34 of the door 30, the ice making chamber cover 240, and the ice making casing 220. The inner space 250 may be partitioned into the ice making space 251 and the ice movement space 252 by the partition plate 230. The discharge opening 231 may be formed on the partition plate 230 to allow ice generated in the ice making space 251 to move to the ice movement space 252. The ice movement space 252 may be defined by the rear plate 34 of the door 30, the ice making casing 220 and the partition plate 230. When the ice making casing 220 defines the front wall and the opposite side walls of the ice movement space 252, the rear plate 34 of the door 30 may define the rear wall and the lower wall of the ice movement space 252, and the partition plate 230 may define the upper wall of the ice movement space 252. Ice in the ice movement space 252 may pass through the opening 34*b* formed on the rear plate 34 of the door 30 and may be supplied to the dispensing space 111 through the chute 115.

The plurality of guide ribs 370 may be formed on the ice making chamber cover 240. Specifically, the plurality of guide ribs 370 may be formed on one wall of the ice making chamber cover 40 facing the rear plate 34 of the door 30. The plurality of guide ribs 370 may extend from one wall of the ice making chamber cover 240 facing the rear plate 34 of the door 30 to face the first wall 321 of the tray cover 320. The plurality of guide ribs 370 may extend from one wall of the ice making chamber cover 240 to be positioned inside the ice making chamber cover 240. The plurality of guide ribs 370 may be integrally formed with the ice making chamber cover 240, Specifically, the plurality of guide ribs 370 may be integrally formed with one wall of the ice making chamber cover 240 facing the rear plate 34 of the door 30.

While the present disclosure has been particularly described with reference to exemplary embodiments, it should be understood by those of skilled in the art that various changes in form and details may be made without departing from the spirit and scope of the present disclosure.

The invention claimed is:

1. A refrigerator, comprising:

a main body including an inner case and an outer case wherein the inner case includes an upper wall and a rear wall;

a storage compartment defined by the inner case;

a door configured to open or close the storage compartment;

an ice making chamber disposed on a rear surface of the door;

a fan configured to supply cold air to the storage compartment and the ice making chamber; and a guide passage integrally formed with the inner case by being recessed into the upper wall of the inner case so as to be exposed to the storage compartment, the guide passage being configured to guide cold air supplied by the fan to the ice making chamber, wherein the guide passage includes:

a first end recessed into the upper wall of the inner case by a first depth and being disposed adjacent to the rear wall of the inner case; and a second end disposed recessed into the upper wall of the inner case by a second depth and being disposed closer to the ice making chamber than the first end, the second depth being less than the first depth such that a portion of the upper wall including the guide passage is inclined downward toward the door.

2. The refrigerator according to claim 1, further comprising:

a cold air inlet through which cold air supplied by the fan is introduced into the storage compartment to the guide passage, is formed on the rear wall of the inner case.

3. The refrigerator according to claim 1, further comprising:

a duct cover defining a cold air supply duct in which the fan is accommodated together with the rear wall of the inner case; and a cold air inlet through which cold air supplied by the fan is introduced into the storage compartment to the guide passage is formed on the duct cover.

4. The refrigerator according to claim 1, further comprising:

a light source installed on the upper wall of the inner case to illuminate the storage compartment and positioned between the guide passage and the ice making chamber to guide the cold air together with the guide passage to the ice making chamber.

5. The refrigerator according to claim 4, wherein the light source includes a light emitting surface inclined toward the ice making chamber with respect to the upper wall of the inner case so that the cold air moves along the light emitting surface.

6. The refrigerator according to claim 1, wherein the door includes:

a front plate forming an outer appearance of the refrigerator together with the outer case of the main body, and a rear plate defining the rear surface of the door and coupled to a rear surface of the front plate, and the ice making chamber includes:

an ice making frame coupled to the rear plate, an ice making casing coupled to at least one of the ice making frame and the rear plate to form an ice making space therein, and an ice making chamber cover including a plurality of cold air inflow slits to allow cold air having passed through the guide passage to be introduced into the ice making space and forming an outer appearance of the ice making chamber together with the ice making casing.

7. The refrigerator according to claim 6, further comprising:

an ice maker disposed in the ice making space, wherein the ice maker includes an ice making tray including ice making cells to store water and formed of a plastic material.

8. The refrigerator according to claim 7, wherein the ice maker further includes a tray cover coupled to an outer side of the ice making tray, and the ice making frame includes a plurality of guide ribs defining a first cold air passage in which a part of cold air introduced through the plurality of cold air inflow slits moves.

9. The refrigerator according to claim 7, wherein the ice making chamber cover has a curved shape to partially surround the ice making space so that the plurality of cold air inflow slits are aligned toward the ice maker.

10. The refrigerator according to claim 8, wherein the tray cover includes a first wall facing the ice making frame, and the plurality of guide ribs extends from the ice making frame to face the first wall of the tray cover.

11. The refrigerator according to claim 8, wherein the tray cover includes a first wall facing the ice making frame, and the first cold air passage includes:

a first section positioned upstream in a direction in which cold air introduced through the plurality of cold air inflow slit moves and extending in a vertical direction of the refrigerator, and a second section positioned downstream in the direction in which cold air introduced through the plurality of cold air inflow slit moves and extending from the first section to be inclined toward the first wall of the tray cover.

12. The refrigerator according to claim 11, wherein cold air moving along the first section of the first cold air passage is brought into direct contact with the first wall of the tray cover, and cold air having passed through the second section of the first cold air passage is brought into direct contact with an outer surface of a bottom of the ice making tray.

13. The refrigerator according to claim 10, wherein the tray cover further includes a second wall facing the first wall, and a plurality of cold air movement holes, through which a second cold air passage in which another part of the cold air introduced through the plurality of cold air inflow slits moves passes, is formed on the second wall of the tray cover.

14. The refrigerator according to claim 13, wherein cold air moving along the second cold air passage is brought into direct contact with one wall of the ice making tray facing the second wall of the tray cover.

15. The refrigerator according to claim 8, wherein the ice making chamber cover and the ice making casing are disposed to be spaced apart from each other in a vertical direction of the refrigerator to define a cold air outlet, each of the plurality of guide ribs includes one end facing downward, and the one end of each of the plurality of guide ribs is positioned between an upper end and a lower end of the cold air outlet.

16. The refrigerator according to claim 6, wherein the ice making chamber cover and the ice making casing are disposed to be spaced apart from each other in a vertical direction of the refrigerator to define a cold air outlet, and cold air introduced into the ice making space is discharged into the storage compartment through the cold air outlet.

17. The refrigerator according to claim 6, wherein the ice making chamber cover further includes a plurality of partition ribs extended toward the ice maker from an inner surface thereof, and to partition the plurality of cold air inflow slits.

18. The refrigerator according to claim 1, wherein the first end of the guide passage has a first width which extends in a horizontal direction perpendicular to a vertical direction of the refrigerator, and the second end of the guide passage has a second width extending in the horizontal direction, the second width being greater than the first width.

* * * * *